United States Patent [19]

Terakawa et al.

[11] Patent Number: 4,841,308

[45] Date of Patent: Jun. 20, 1989

[54] SLOTTED WAVEGUIDE ANTENNA ASSEMBLY

[75] Inventors: Takashige Terakawa, Yokohama; Mutsumi Takahashi, Kawasaki; Noriyuki akaba, Tokyo, all of Japan

[73] Assignee: Tokyo Keiki Co., Ltd., Tokyo, Japan

[21] Appl. No.: 229,759

[22] Filed: Aug. 8, 1988

Related U.S. Application Data

[63] Continuation of Ser. No. 71,038, Jul. 8, 1987, abandoned, which is a continuation-in-part of Ser. No. 702,379, Feb. 15, 1985, abandoned.

[30] Foreign Application Priority Data

| | | | |
|---|---|---|---|
| Feb. 16, 1984 | [JP] | Japan | 59-27722 |
| Feb. 21, 1984 | [JP] | Japan | 59-23379 |
| Feb. 25, 1984 | [JP] | Japan | 59-34710 |
| Mar. 10, 1984 | [JP] | Japan | 59-34689 |
| Mar. 10, 1984 | [JP] | Japan | 59-46090 |

[51] Int. Cl.[4] ..... H01Q 13/10

[52] U.S. Cl. ..... 343/771; 343/785

[58] Field of Search ..... 343/771, 785, 786

[56] References Cited

U.S. PATENT DOCUMENTS

| | | | |
|---|---|---|---|
| 2,730,717 | 1/1956 | Katchky et al. | 343/756 |
| 2,996,715 | 8/1961 | Rumsey et al. | 343/767 |
| 3,039,097 | 6/1962 | Strumwasser et al. | 343/771 |
| 3,146,449 | 8/1964 | Serge et al. | 343/704 |
| 3,234,558 | 2/1966 | Borgiotti | 343/756 |
| 3,390,393 | 6/1968 | Upton | 343/708 |
| 4,488,157 | 12/1984 | Terakawa et al. | 343/771 |

FOREIGN PATENT DOCUMENTS

| | | | |
|---|---|---|---|
| 0447856 | of 1969 | Japan | 343/771 |
| 2158650 | 11/1985 | United Kingdom | 343/771 |

*Primary Examiner*—William L. Sikes
*Assistant Examiner*—Doris J. Johnson
*Attorney, Agent, or Firm*—Cushman, Darby & Cushman

[57] ABSTRACT

A slotted waveguide antenna assembly includes a slotted waveguide, a dielectric beam shaper and reflectors which are fixed and held by a holder member.

The dielectric beam shaper is formed from a pair of dielectric plate members. The dielectric plate members are so arranged that they are slightly closer at the forward ends than the base ends, thus providing a nonparallel arrangement. The inclination of the dielectric plate members is selected within a range of $0.8 \leqq d/D < 1$ (D: a distance between the dielectric plate members at the base portions, d: a distance between the dielectric plate members at the forward portions).

The dielectric plate members have a thickness which produces a phase difference, between electromagnetic waves reflected by inner surfaces of the respectivie dielectric plate members that are opposite each other. The electromagnetic waves reflected by interfaces at external surfaces of the respective dielectric plate members move towards the space between the dielectric plate members, and substantially cancel each other because of the phase difference.

15 Claims, 10 Drawing Sheets

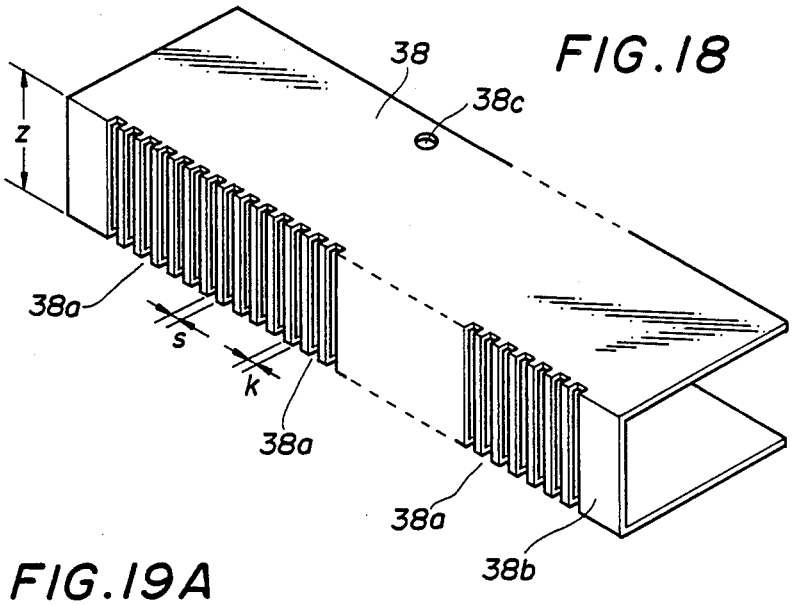
FIG. 18
FIG. 19A
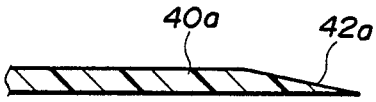
FIG. 19B
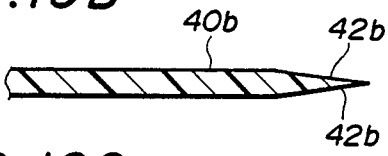
FIG. 19C
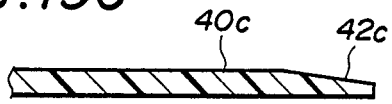
FIG. 19D
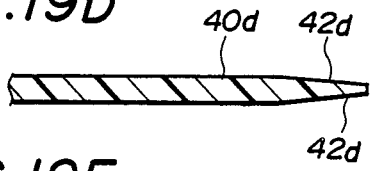
FIG. 19E
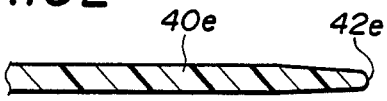

SLOTTED WAVEGUIDE ANTENNA ASSEMBLY

This is a continuation of application Ser. No. 07/071,038, filed July 8, 1987, abandoned, which is a continuation-in-part of Ser. No. 702,379, filed Feb. 15, 1985, which was abandoned upon the filing hereof.

BACKGROUND OF THE INVENTION

1. Field of the Invention

This invention relates to a microwave antenna assembly suitable as an antenna for marine radars, and more particularly to a slotted waveguide antenna assembly provided with a dielectric beam-shaper so as to be compact and light in weight. The term "dielectric beam-shaper" is used here to mean a dielectric arrangement comprising a pair of dielectric plate members for guiding electromagnetic waves not therethrough but therebetween.

2. Prior Art

A slot array antenna assembly comprising a slotted waveguide array is already known This type of antenna assembly is more compact and lighter in weight than a parabolic reflector antenna and therefore it is widely used for marine radars or the like. However, the slotted waveguide can provide a beam directivity only in a plane including an axis of the slotted waveguide (hereinafter referred to as a horizontal plane) and cannot provide a beam directivity in a plane perpendicular to the horizontal plane (hereinafter referred to as a vertical plane). For this reason, the antenna assembly of this type is usually provided with a flared horn to obtain a directive beam in the vertical plane. Such arrangements have been disclosed in U.S. Pat. No 2,730,717.

In order to obtain high directivity in the vertical plane, the conventional slot array antenna assembly needs a flared horn of large diameter in that plane, though it is much smaller in diameter as compared with the parabolic reflector antenna. Therefore, the entire antenna assembly is inevitably made bulky and heavy. The large aperture diameter in the vertical plane has another drawback, namely the increase in wind pressure when the antenna assembly is used in the open air.

The wind pressure has a great influence not only upon the strength of the antenna itself but also upon the rotational driving system of the same in open seas where winds are stronger. In this connection, it should be noted that the detecting ability of the radar is increased as the antenna is raised higher. However, if the heavy antenna is located at a high position on a ship, the righting ability of the ship is decreased and the ship may be capsized in rough seas. For this reason, it is very important for marine radar antennas to be light and to reduce the wind pressure.

Various attempts have been made to increase the directivity within the vertical plane without using a flared horn having a large-diameter aperture. For example, U.S. Pat. No. 3,234,558 to Borgiotti discloses a slot antenna assembly using dielectric members.

The antenna assembly of U.S. Pat. No. 3,234,558 includes, as a wave source, a so-called shunt-edge slotted waveguide in which slots are formed through the narrow side hereof. Two metal, conductive plates are disposed in parallel so that the guide may be held centrally in a space defined therebetween. A radiating dielectric structure is fitted to the forward ends of the plates, namely, fitted in an opening formed by the two plates. This radiating dielectric structure is formed in a U-shape with the base end portions connected to the plates and the curved portion projecting forwardly.

Although the operating principle and characteristics of the antenna assembly can not be known from the specification of the U.S. Patent because the specification does not refer to the propagation mode and the radiation pattern of the antenna assembly, it may be inferred from the structure as illustrated in the drawing that the antenna assembly according to the U.S. Patent utilizes the radiation in a mode of propagation between the dielectric plate member.

More specifically, the antenna assembly has a radiating dielectric structure with a circular half cylindrical closure, which is considered to be for preventing reflection of a progressive wave to enhance the radiation efficiency. This shows there is an electromagnetic wave propagation mode between the dielectric plate member of the U-shape and between the dielectric plate member. A considerable portion of electromagnetic wave energy is transmitted to the forward end portion of the radiating dielectric structure through the dielectric plate member and radiated from the end portion into the air.

In the antenna assembly of the U.S. Patent, however, there is discontinuity in the impedance at joint portions of the two metallic conductive plates and the radiating dielectric structure an electromagnetic wave is also radiated from the joint portions.

Thus, the antenna assembly of the U.S. Patent is considered to have two wave sources at the forward end and base end portion of the radiating dielectric structure.

The antenna assembly having two wave sources provides a synthesized radiation pattern formed of radiations from the two wave sources. However, the electromagnetic wave generated due to such mismatching impedances is not radiated in a direction of an extension of the radiating dielectric structure and forms a large side lobe. Thus, the conventional antenna assembly can never assure the reduction of side lobes theoretically and can not realize side lobe suppression experimentally, either.

This can also be seen from the fact that no antenna assembly as disclosed in U.S. Pat. No. 3,234,558 have been successfully put into practical use or put into the market. The operating principle of this type of the antenna assembly has not sufficiently been known.

With a view to overcoming these problems, some of the inventors of the present invention previously proposed a slotted waveguide antenna assembly provided with a dielectric wave-guiding arrangement and a smallsized reflector which is used in place of the flared horn to reduce the diameter of the aperture thereof in the vertical plane for reducing the size and weight of the antenna assembly and for reducing the counter-wind area of the antenna assembly (U.S. Ser. No. 350,739 now U.S. Pat. 4,488,157).

FIG. 21 illustrates one form of the slotted waveguide antenna assembly proposed by them. In the slotted waveguide antenna assembly of FIG. 21, a web of a holder member 12 is formed in a channel-shape and has a groove 12*a*. A slotted waveguide 10 is fitted and fixed in the groove 12*a*. A dielectric wave-guiding arrangement 16 comprising a pair of dielectric plate members 16*a*, 16*b* which are sufficiently thin as compared with a working wavelength, is provided in front of the slotted waveguide 10 so as to extend forwardly, defining a forward space therebetween. Reflectors 20, disposed at an aperture portion of the holder member 12 on the external surfaces of the respective dielectric plate members 16*a*, 16*b*, reflect an electromagnetic wave radiated through the base portions of the dielectric plate members 16*a*, 16*b*.

With this slotted waveguide antenna assembly, a component of the electromagnetic wave radiated from the slotted waveguide 10 which has a small angle with reference to the horizontal plane, is reflected so as to be guided forwardly by the inside faces (faces opposite each other) of the respective dielectric plate members 16*a*, 16*b*. A component having a large angle is also reflected by the reflectors 20 forwardly so as to increase the electromagnetic wave energy directed forwardly for providing a directive beam and to reduce side lobes.

In this case, the reflectors 20 may be short because they are required only to reflect the component of the electromagnetic wave which is radiated from the base portions of the dielectric plate members at large angles. Therefore, an area of the aperture can be reduced as compared with the conventional flared horn. For example, the height of the aperture, which is four times that of the working wavelength in the conventional flared horn-type antenna assembly, can be reduced to about twice the wavelength in this conventional slotted waveguide antenna assembly. Thus, the actual area of the aperture can be reduced.

Although the slotted waveguide antenna assembly as illustrated in FIG. 21 is sufficient for practical usage, further reduction of the side lobe level is sometimes required.

The reduction of the side lobe level may be attained in various ways. Most simply, the side lobe level can be lowered by prolonging the reflectors and enlarging the aperture area. However, this method is not desirable because it increases the weight of the assembly and increases the wind pressure.

This type of antenna assembly involves another problem in that the side lobe level is increased to an extent which is not negligible if the dielectric plate members 16*a*, 16*b* are prolonged forwardly so as to change another characteristic of the radiated electromagnetic wave, for example, to sharpen the pattern of a main lobe in the vertical plane, i.e. to reduce the half-power beam width.

This invention has been achieved in order to obviate the problems involved in the conventional antenna assembly.

It is therefore an object of the present invention to provide a slotted waveguide antenna assembly which is capable of reducing side lobes in the vertical plane only by changing the configuration and mounting state of the dielectric plate members without increasing the entire weight of the assembly and the aperture area of the reflectors.

It is another object of the present invention to provide a slotted waveguide antenna assembly which is capable of supressing side lobes to an extent which is negligible in practical use even if they are raised by a change in characteristics of the antenna assembly.

DISCLOSURE OF THE INVENTION

In accordance with the present invention, side lobes can be reduced only by changing the configurations of the dielectric plate members and the mounting states thereof without increasing weight and aperture area. The present invention may be modified in various ways to provide a slotted waveguide antenna assembly of low side lobes suited for various uses.

The present invention is embodied by a slotted waveguide antenna assembly including a slotted waveguide which is fixed and held, at its back side, by a holder member.

This slotted waveguide antenna assembly comprises a dielectric beam shaper formed of a pair of dielectric plate members, said dielectric plate members having base portions which are supported by said holder member and having forward end portions which extend to project forwardly of said slotted waveguide to define a space therebetween; and a pair of reflectors provided at the base portions of the respective dielectric plate members and supported by said holder member for reflecting electromagnetic waves radiated through the base portions of the respective dielectric plate members.

The dielectric plate members have a thickness which produces a phase difference, between electromagnetic waves reflected by inner surfaces of the respective dielectric plate members towards the space between the dielectric plate members and electromagnetic waves reflected by interfaces at external surfaces of the respective dielectric plate members towards the space between the dielectric plate members. The electromagnetic waves being reversed in phase substantially cancel each other.

The pair of dielectric plate members are so disposed that a distance D between the dielectric plate members at the base portions thereof differs from a distance d between the dielectric plate members at the forward portions thereof within a range of $0.8 \leqq d/D < 1$.

Each of the dielectric plate members is made of a planar plate. The length of each of the dielectric plate members, from the base end to the forward end, may be several times as long as the working wavelength. The pair of dielectric plate members is disposed so that a distance or spacing D between the dielectric plate members at their base portions may preferably be shorter than the wavelength of the working electromagnetic waves so long as radiation of a desired propagation mode is not suppressed. The holder member for supporting the pair of dielectric plate members is preferably a channel member. In this case, the dielectric plate members are arranged along parallel sides of the channel member.

The forward, tip end of each of the dielectric plate members may be cut off. However, the tip end of each of the dielectric plate members may preferably be processed, i.e., slanted or tapered, or rounded. With this processed tip end, electromagnetic energy propagating within the thickness of the dielectric plate member to reach its tip end, if any, would hardly be reflected at the end. Thus, a back lobe, which would otherwise be increased by reflected waves, can be suppressed.

The slotted waveguide antenna assembly of the present invention may preferably comprise a support member for supporting the dielectric plate members of a material transparent to the working electromagnetic waves, e.g. a foam material, at least between the dielectric plate members or on the exterior surfaces of the dielectric plate members.

The slotted waveguide antenna assembly may further comprise a radome made of a dielectric material which covers the pair of dielectric plate members. In this case, foam members may further preferably be provided inside the radome as the supporting members. This arrangement may increase the strength of the antenna assembly.

The reflectors of the present antenna assembly comprise a material which reflects the electromagnetic waves. In general, metals may be employed. To reduce the weight of the reflector, the reflector may preferably have a reflecting layer of conductive material inside or on a synthetic resin plate. The reflecting layer may be formed, for example, by a metallic film, metallic net, a perforated metallic plate, or woven or non-woven cloth containing metallic fibers.

In the case the reflectors each have the reflecting layer of conductive material provided inside or on the synthetic resin plate, the reflectors and the radome are combined integrally to form a cover. This can increase the strength of the antenna assembly as well as simplify the manufacturing process.

The radome may preferably be made of a dielectric plate having a thickness which produces such a phase difference, between electromagnetic waves reflected by an inner surface of said dielectric plate towards an interior space of said radome and electromagnetic waves reflected by an interface at an external surface of the dielectric plate towards said interior space, that the electromagnetic waves substantially cancel each other. In this case, an effect similar to those of the dielectric plate members may be obtained.

OPERATION

With the arrangement as described above, the pair of dielectric plate members supported by the holder function as a perfect leaky-wave antenna. In this leaky-wave antenna, the electromagnetic waves radiated from the wave source (slotted waveguide) are incident upon the dielectric plate members and transmitted therethrough and then radiated into the air from external faces of the respective dielectric plate members, which are opposite to their incident faces. At this time, a plurality of wave sources are newly formed. Therefore, the radiation pattern of this leaky-wave antenna is a synthesization of the radiations from these wave sources.

In this connection, it is to be noted that there is apparently no electromagnetic waves incident between the dielectric plate members since the waves reflected from the inner surfaces of the dielectric plate members and the waves reflected from the interfaces between air and the dielectric plate members cancel each other. This is due to the fact that the thickness of the dielectric plate members is so thin that differences in paths between those electromagnetic waves can be negligible and that the latter waves are reversed in phases when they are reflected. Thus, in the slotted waveguide antenna assembly of the present invention, there is no between-plates-propagation mode except for the electromagnetic waves travelling straight forwardly from the slotted radiator.

As a result of this, a large portion of the electromagnetic wave energy is radiated into free space from the external surfaces of the dielectric plate members. At this time, electromagnetic waves are radiated at various points on the external surfaces of the dielectric plate members, with delays in phases corresponding to the positions from the base ends to the forward ends of the dielectric plate members. Thus, the antenna assembly of the present invention operates like an end-fire array antenna, with such points providing new wave sources, and provides a radiation characteristic similar to the end-fire array antenna.

Furthermore, the pair of, dielectric plate members are arranged not in parallel, but with the forward ends being slightly closer. With this arrangement, although not analyzed theoretically, side lobes are reduced as compared with a parallel arrangement of the dielectric plate members. When the dielectric plate members are disposed in a non-parallel arrangement in such a manner that the distance D between the dielectric plate members at their base end portions differs from the distance d between the plate members at their forward end portions within a range of $0.8 \leqq d/D < 1$, the main lobe can be kept in a desired beam shape. If d/D is smaller than 0.8, the side lobes will be lowered, but the main lobe is increased in width and is diverged, which would prevent practical application for a radar antenna.

The antenna assembly of the present invention operates only by leaky waves and the thickness of the dielectric plate members are selected so that no propagation mode may exist. By this reason, the thickness of the dielectric plate members is one tenth or less, preferably one twentieth or less, of the working wavelength. As a result of this, the antenna assembly of the present invention can be reduced in weight as compared with the antenna which utilizes a propagation mode.

DESCRIPTION OF THE DRAWINGS

FIG. 18 is a partly omitted perspective view of a grid employable in the slotted waveguide antenna assembly of FIG. 15;

FIGS. 19A to 19E are fragmentary enlarged sectional views of various modifications of dielectric plate members employable in the foregoing embodiments;

PREFERRED EMBODIMENTS

Figure 1:
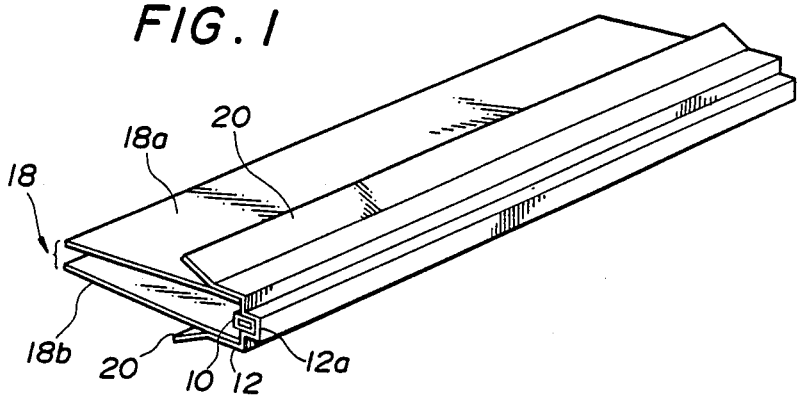
FIG. 1 is a perspective view of a first form of the slotted waveguide antenna assembly according to the present invention.

Referring now to the drawings, there are illustrated preferred embodiments of the present invention.

Figure 2:
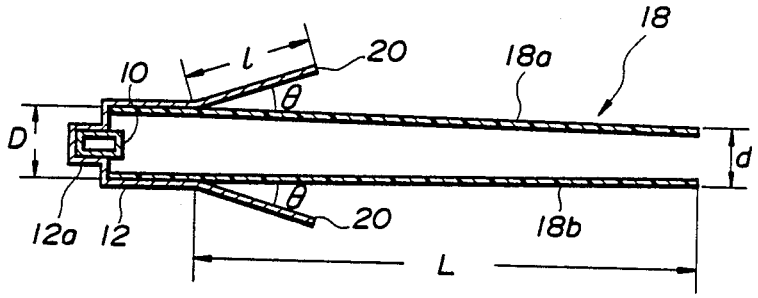
FIG. 2 is a sectional view of the slotted waveguide antenna assembly of FIG. 1.

FIGS. 1 and 2 illustrate a first form of a slotted waveguide antenna assembly according to the present invention which is usable as an antenna for a marine radar of 9410 MHz. A slotted waveguide 10, a dielectric beam shaper 18 and reflectors 20 are fixed to and held by a holder member 12. In this embodiment, the reflectors 20 are formed integrally with the holder member 12.

The slotted waveguide 10 has a plurality of slots formed in an array on a front face thereof. Since the slotted waveguide 10 radiates an electromagnetic wave from the slots, it is supported at the rear side thereof.

The holder member 12 is made, for example, of a channel-shaped material having metal walls or metallized walls. A plastic plate coated with metal by plating or the like is an example of such metallized materials.

The holder member 12 has a groove 12*a* extending along the length of the web. The groove 12*a* receives the slotted waveguide 10 fixed therein and supports the slotted waveguide 10 at the rear side thereof. The holder member 12 prevents the electromagnetic wave from leaking rearwardly.

The dielectric plate members 18*a*, 18*b* are supported by parallel portions of the channel material constituting the holder member 12 as will be described in detail later. A distance between the opposite, inner surfaces of the parallel portions is selected to be shorter than a wavelength of a working electromagnetic wave. However, the distance should not be smaller than half of the wavelength so that the radiation of the electromagnetic wave may not be suppressed.

The dielectric beam shaper 18 is formed of two dielectric plate members, for example, of synthetic resin materials such as fiber reinforced plastics (FRP). Epoxy resin-bonded glass fiber is an example of FRP.

The dielectric beam shaper 18 is so constructed that the dielectric plate members 18*a*, 18*b* are disposed in a non-parallel arrangement, in which the forward, tip end portions of the dielectric plate members may be closer than the base end portions thereof.

In the embodiment as illustrated, each of the dielectric plate members 18*a*, 18*b* is a planar plate member which is slightly bent in the vicinity of the base portion thereof. The bent dielectric plate members 18*a*, 18*b* are disposed so that extensions of the outside faces of the respective plate members may be closer at the forward portions thereof, and the base portions thereof are fixed to the insides of parallel portions of the holder member 12. Thus, the dielectric beam-shaper 18 is constituted.

The manner of the bending of the dielectric plate members 18*a*, 18*b* may be varied according to the angle of the length and the aperture of the reflectors, but the bending is generally made at an angle as small as 1° to 5°. However, if the parallel portions of the holder member 12 have inclinations, the dielectric plate members need not be bent. Alternatively, the planar dielectric plate members may be bent when they are mounted on the holder member 12.

The inclination angles of the dielectric plate members 18*a*, 18*b* are determined by setting a distance D between the external surfaces of the dielectric plate members at their base portions and a distance d between the external surfaces of the dielectric plate members at their forward end portions. The distances D and d are within a range of $0.8 \leqq d/D < 1$.

The inclination angles of the dielectric plate members 18*a*, 18*b* have influences upon generation of side lobes. According to the experiments conducted by the inventors of the present invention, side lobes are reduced as the angle becomes larger. However, when the angle becomes too large, the radiation pattern of the main lobe deteriorates. For this reason, it is preferred that the inclination angle be within the range as specified above.

The dielectric plate members 18*a*, 18*b* should be sufficiently thin as compared with the working wavelength, for example, one tenth of the working wavelength or less. In the embodiment as illustrated, the thickness t of each of the plate members is 0.078 wavelength. The plate members should be thinner, as the dielectric constant thereof becomes larger. In the present embodiment, the dielectric members have a relative dielectric constant of about 2.8. The reason the thickness t of the plate members should be small is to prevent deterioration of the radiation pattern due to the phenomenon that the electromagnetic wave is trapped in the dielectric plate members.

Although it may be considered that the projected lengths L of the dielectric plate members are more desirable as they become longer, they, in fact, are preferably several times the wavelength, if the inward inclinations of the plate members are taken into consideration. In the present embodiment, the length L is 3.4 times the working wavelength.

The side lobe is reduced as the distance between the dielectric plate members 18*a*, 18*b* becomes smaller. However, at the base portions of the dielectric plate members 18*a*, 18*b*, if the opening height of the holder member 12 is smaller than half of the working wavelength, power radiation from the slot wave guide 10 is suppressed. For this reason, the distance between the dielectric plate members 18*a*, 18*b* should inevitably be half of the working wavelength or more in such a mounting structure of the dielectric plate members as in the present embodiment. However, if another type of holder member 12 is employed, there is no such limitation.

In the present embodiment, the distance D between the faces of the respective dielectric plate members 18*a*, 18*b* (which are remote from each other, i.e. the external faces of the respective plate members) corresponds to a wavelength of 0.78. On the other hand, the distance d at the tip end portions of the dielectric members is determined by the lengths of the dielectric plate members 18*a*, 18*b* and the inclination angles thereof and it corresponds to a wavelength of 0.69 in the present embodiment. Therefore, d/D is 0.88.

The reflectors 20 are made of metal plates or metallized plates. These reflectors 20 are disposed externally on the respective dielectric plate members 18*a*, 18*b*, and are fixed and carried by the holder member 12. In the present embodiment, they are formed integrally with the holder member 12 at the opening portion thereof. Alternatively, the reflectors 20 may be separate members from the holder member 12.

The smaller the side lobe, the longer the lengths 1 of the reflectors 20 may be, but at the same time, the wind pressure becomes stronger as the length 1 becomes longer. Therefore, the length 1 is preferred to be about twice the working wavelength. In this embodiment, the length 1 is 1.9 times the working wavelength.

The angle $\theta$ of the aperture of the reflectors 20 is determined experimentally, taking the angle of incidence of electromagnetic wave transmitted through the dielectric plate members and the wind pressure into consideration. In the present embodiment, it is 25°.

The operation of the slotted waveguide antenna assembly according to the present invention will now be described.

In the arrangement of the present embodiment, the operation of the present invention is not completely known theoretically, but it may be presumed as follows:

The electromagnetic wave radiation operation by the pair of dielectric plate members will be described, while referring to FIG. 3.

In the configuration as described above, the channel member reflects, by the metallic wall plates, electromagnetic waves radiated from the slotted waveguide which is fitted to a vertical side of the channel member to propagate the waves forwardly.

The pair of dielectric plate members disposed along the parallel portions of the channel member function as a perfect leaky-wave antenna as described above. In this leaky-wave antenna, the electromagnetic waves radiated from the wave source are incident upon the dielectric plate members, propagated through the plate members and radiated into the air outside of the dielectric plate members, from the faces of the respective plate members which are opposite to the respective incident faces thereof. At this time, a plurality of wave sources are formed newly on the outer faces of the respective plate members. The radiation pattern obtained is a synthesis of the radiations from these wave sources.

Figure 3:
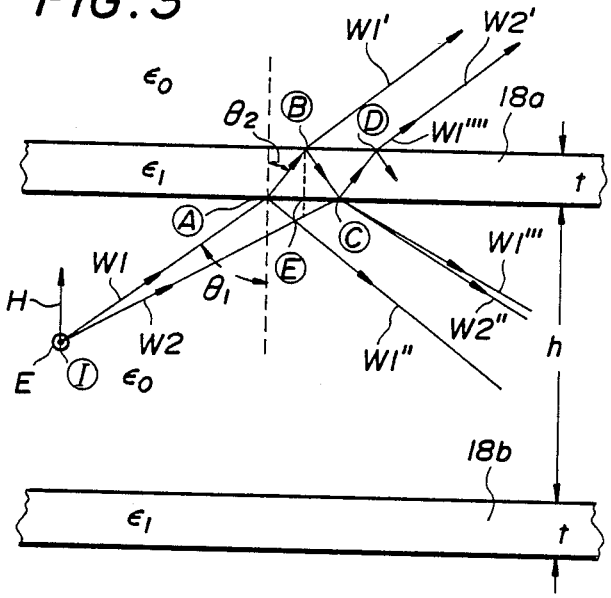
FIG. 3 is an explanatory view showing the operation of the slotted waveguide antenna assembly of FIG. 1.

FIG. 3 shows fragments of the dielectric plate members 18*a*, 18*b*. The dielectric plate members 18*a*, 18*b* constituting the beam shaper have a thickness t and are disposed to be spaced by h ($d \leqq h \leqq D$) from each other. Now, if it is assumed that the electromagnetic waves incident between these thin dielectric plate members are spherical waves, the source of the electromagnetic waves may be replaced by a point wave source Ⓘ. In this case, the point wave source Ⓘ is centrally positioned in the spacing h. As shown in FIG. 3, this point wave source Ⓘ produces an electric field E in a direction perpendicular with respect to the plane of the paper carrying FIG. 3 and a magnetic field H in a direction perpendicular with respect to the dielectric plate members 18*a*, 18*b*.

A radiation wave W1 emanating from the wave source Ⓘ is incident upon a point Ⓐ on the inner face of the dielectric plate member 18*a* having a relative dielectric constant $\epsilon 1$. The radiation wave W1 is diverged into a radiation wave W1″ reflected from the point Ⓐ and a refraction wave passing through the inside of the dielectric plate member 18*a* towards a point Ⓑ. An incident angle and a refraction angle of the radiation wave W1 at the point A are denoted by $\theta 1$ and $\theta 2$, respectively.

The refraction wave, which has reached the point Ⓑ, is further refracted and divided into a refraction wave W1′ and a reflection wave reflected at the point Ⓑ towards a point Ⓒ. Similarly, the reflection wave is divided at the point Ⓒ into a refraction wave W1‴ refracted towards a space and a reflection wave towards a point Ⓓ.

The reflection wave is further divided, at the point Ⓓ, into a refraction wave W1⁗ refracted towards a space and a reflection wave. However, the refraction wave W1⁗ is attenuated by far as compared with the refraction wave W1′ and the amplitude of the refraction wave W1⁗ is as negligible.

The relationship between $\theta 1$ and $\theta 2$ will be described referring to FIG. 3.

The relationship between the incident angle $\theta 1$ and the refraction angle $\theta 2$ may be expressed according to Snell's law as follows:

$$\sin \theta 1 / \sin \theta 2 = \sqrt{\epsilon 1}$$

Therefore, the refraction angle $\theta 2$ is given by $$\theta 2 = \arcsin \left( \frac{\sin \theta}{\sqrt{\epsilon 1}} \right)$$

According to the formulae as given above, a variable range of the refraction angle is expected to be narrowed as the relative dielectric constant 1 becomes larger and the incident angle $\theta 1$ is increased to approach 90°. This means that even if the incident angle $\theta 1$ upon the dielectric plate member 18*a* is largely changed around 90°, the refraction angle $\theta 2$ is hardly varied. When the spacing h between the dielectric plate members is much smaller than the length of the dielectric plate member 18*a*, the relation as described above can be applied to most portions on the inner face of the dielectric plate member 18*a*, which is a face confronting an inner face of the oppositely provided dielectric plate member 18*b*.

In FIG. 3, if the incident angle $\theta 1$ is selected to be an angle which satisfies the above relationship and an intersection of a normal line from the point Ⓑ to the inner face of the dielectric plate member 18*a* is assumed as E, there is the following relationship:

$$\angle ABE = \angle CBE = \theta 2, \ \overline{AB} = \overline{BC}$$

On the other hand, a radiation wave W2 emanating from the wave source Ⓘ is incident upon the point Ⓒ, it is divided into a re wave W2″ reflected at the point Ⓒ towards the space between the dielectric plate members and a refraction wave refracted at the point towards the point Ⓓ.

A phase difference between the refraction wave W1‴ which results from the refraction of the radiation wave W1 at the point Ⓒ and the reflection wave W2″ which results from the reflection of the radiation wave W2 at the point Ⓒ is a sum ($\pi + \Delta\phi$) of a phase difference $\Delta\phi$ produced between a propagation path of the radiation wave W1 to the point Ⓒ, namely, $\overline{IA} + \overline{AB} + \overline{BC}$ and a propagation path of the radiation wave W2 towards the point Ⓒ, namely $\overline{IC}$, and a phase difference $\pi$ produced by the inversion of the phase which is caused when the radiation wave W2 enters a dense medium (dielectric plate member 18*a*) from a sparse medium (air) and is reflected at an interface between these different media.

In this connection, it is to be noted that when a wave enters a sparse medium (air) from a dense medium (dielectric plate member 18*a*) and is reflected at the interface therebetween as when the refraction wave of the radiation wave W1 enters the point Ⓑ, there is produced phase difference $\pi$ between the incident wave and the reflection wave.

The phase difference $\Delta\phi$ is given as follows:

$$\Delta\phi = 2\left(\frac{2\pi\sqrt{\epsilon 1}}{\lambda_0}\cdot\frac{t}{\cos\theta 2}\right) - \frac{2\pi(r2 - r1)}{\lambda_0}$$

$$= \frac{4\pi t\sqrt{\epsilon 1}}{\lambda_0\cos\theta 2} - \frac{2\pi(r2 - r1)}{\lambda_0}$$

Where r2 and r1 as given represent the distance $\overline{IC}$ and the distance $\overline{IA}$, respectively, and $\lambda 0$ is a free space wavelength of electromagnetic waves. In this case, $r2 - r1 = \Delta r$ can be considered to be very small and the thickness t is as small as one tenth of the wavelength $\lambda 0$ or less. Therefore, the phase difference $\Delta\phi$ is small and the phase difference between the refraction wave W1''' and the reflection wave W2'' can be considered to be close to $\pi$. Thus, the waves are substantially cancelled by each other. As a result of this, there is little electromagnetic waves which propagate between the pair of dielectric plate members 18*a* and 18*b*. If the thickness t is selected to be one twentieth or less of the wavelength $\lambda 0$, the phase difference $\Delta\phi$ becomes extremely small and the phase difference between the refraction wave W1''' and the reflection wave W2'' can be considered to be approximately $\pi$, so that the waves are cancelled by each other more completely.

As a result of this, a large portion of the electromagnetic wave energy radiated from the slotted waveguide is radiated from the external faces of the dielectric plate members 18*a* and 18*b*. In this case, a plurality of points similar to the points Ⓑ and Ⓓ are further formed on the external face of the dielectric plate member 18*a* between the point Ⓐ and the forward, tip end of the dielectric plate member and electromagnetic waves are considered to be radiated from these points.

This means that a considerable portion of the radiation wave from the wave source Ⓘ may be approximately substituted with new waves sources located on the points Ⓑ, Ⓓ . . . , at which the dielectric plate member 18*a* is divided into n if n points are assumed to be formed at intervals of l1. In other words, the radiation pattern of the wave source Ⓘ placed through the dielectric plate member 18*a* may be approximated to be or equivalently substituted by a synthesis of the radiation patterns of the n point wave sources positioned on the external face of the dielectric plate member 18*a* at intervals l1, according to the Huygens' principle.

The plural points as referred to above are sequentially remote from the wave source Ⓘ and the radiation waves reaching to respective points from the wave source Ⓘ have phases which defer or lag sequentially. Based on this phenomenon, the radiations of the electromagnetic waves from the respective points may be understood in a further different way. More particularly, it can be assumed that the n wave sources positioned at the intervals l1 are supplied, from the point B, with energy of progressive waves having a phase velocity of Vp=mc to excite the respective wave sources. In this case, c is the velocity of light.

Since $m<1$, it can be understood that Vp is a bit lower than the velocity c of light. In this connection, it can be said that the dielectric plate member 18*a* which is sufficiently thin as compared with the wavelength operates as an end-fire antenna supplied of a slow-wave structure.

With the directivity characteristics of such an endfire antenna, the direction of the maximum radiation is determined by the phase velocity Vp. At this time, since the phase velocity Vp is much smaller than the velocity of light, the maximum radiation appears at an angle slightly upward with reference to the longitudinal direction of the dielectric plate member 18*a* (which is assumed as 0°). On the other hand, the maximum radiation in the directivity characteristics in connection with the other dielectric plate member 18*b* appears at a slightly downward angle. Thus, the directivity characteristics associated with the dielectric plate members 18*a*, 18*b* appear symmetrically with the axis of the antenna, so that the maximum radiation in the synthesized directivity characteristics appears at 0°, i.e., in the longitudinal direction between the plate members.

In the present embodiment, the pair of dielectric plate members are so disposed that the forward, tip end portions of the dielectric plate members 18*a*, 18*b* may be closer to each other and the external faces of the dielectric plate members 18*a*, 18*b* are slightly inclined with a horizontal plane. This arrangement is effective to further lower the side lobes.

Although the pair of dielectric plate members of the present invention operate as described above, the theory as discussed above is applicable only when the incident angle of the electromagnetic wave incident upon the dielectric plate member is relatively large. Therefore, the electromagnetic wave which is incident upon the dielectric plate member at a relatively small incident angle will progress to free space and will never form wave sources which produce such radiation characteristics.

However, such a large incident angle can be obtained only at portions close to the wave source, namely, in the vicinity of the base portion of the dielectric plate member. Therefore, in the present embodiment as well as in other embodiments, the reflectors 20 are provided to reflect the electromagnetic waves incident at small incident angles upon the dielectric plate members to be propagated forwardly. These electromagnetic waves are limited only around the aperture portion of the channel member and there is no need to provide reflectors of large aperture.

Although the reflectors 20 functioning similarly to the conventional flared horn are provided in the antenna assembly of the present invention, the aperture of the reflectors 20 can be made much smaller than the flared horn which is required to reflect electromagnetic waves radiated over a wide range. As a result of this, the structure of the reflector may be smaller, the weight may be reduced and the wind-resist performance can be improved very much. This also enables the apparatus for rotating the antenna assembly to be small-sized.

Figure 4:
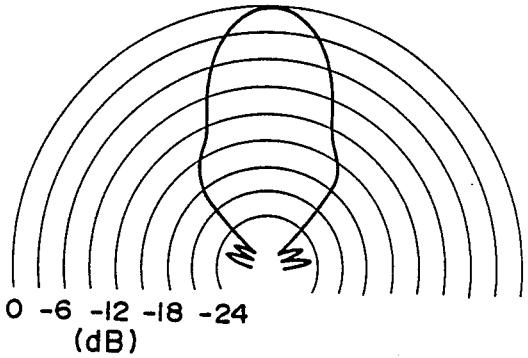
FIG. 4 is a characteristic diagram of an actually measured radiation pattern of the slotted waveguide antenna assembly of FIG. 1.
Figure 5:
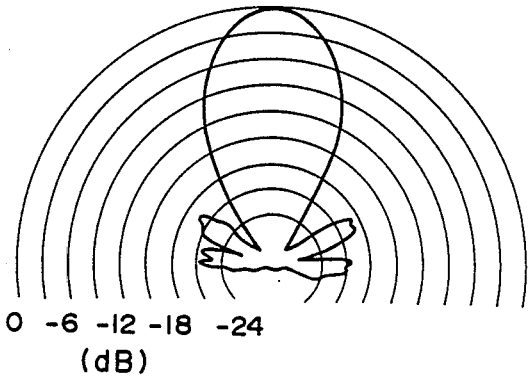
FIG. 5 is a similar characteristic diagram of an actually measured radiation pattern of the conventional slotted waveguide antenna assembly illustrated in FIG. 21.
Figure 21:
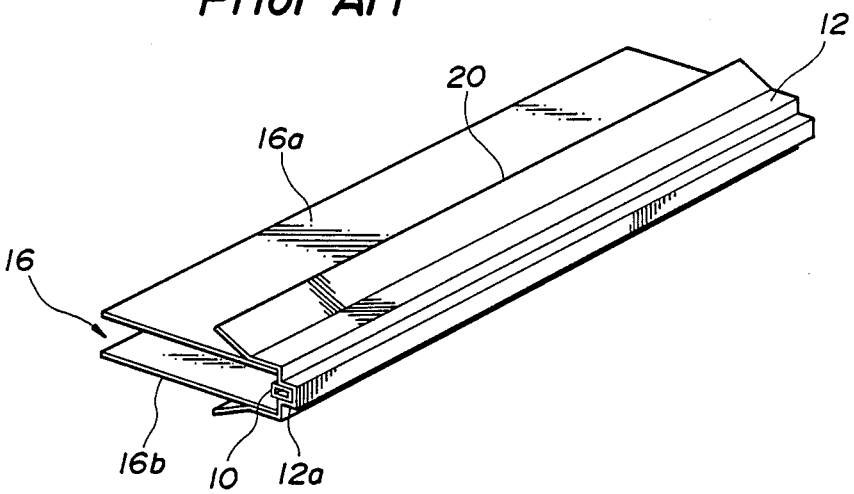
FIG. 21 Prior Art
FIG. 21 is a perspective view of a conventional slotted waveguide antenna assembly having a dielectric waveguide arrangement.

In the slotted waveguide antenna assembly of the present embodiment as configured above, an electromagnetic wave having a frequency of 9410 MHz is radiated to measure the radiation directivity characteristics. The obtained electromagnetic wave radiation pattern is shown in FIG. 4. Similar measurement of the radiation directivity characteristics were obtained of the slotted waveguide antenna assembly of FIG. 21 which is identical with the slotted waveguide antenna assembly of this embodiment except that the dielectric plate members 18*a* and 18*b* are disposed in parallel to each other, keeping a spacing of 0.78 wavelength therebetween. The obtained results are shown in FIG. 5. The comparison of the measurement results shows that the side lobe level which is larger than −20 dB in the latter measurement is lowered to a level as low as −24 dB or less in the former measurement.

Thus, according to the present embodiment, the side lobe can be reduced only by changing the arrangement of the dielectric plate members, without increasing the weight and the aperture area.

The reason why the side lobe level is lowered by inclining the dielectric plate members is not known theoretically, but the inventors have experimentally confirmed the lowering effect due to the inclined arrangement of the dielectric plate members. However, the inventors have further confirmed that the pattern of the main lobe is deteriorated if the dielectric plate members are inclined too much.

Changes of the electromagnetic wave radiation patterns obtained when the inclination angles of the dielectric plate members 18*a*, 18*b* are changed in the slotted waveguide antenna assembly which is substantially identical with that of the first embodiment are shown in FIGS. 12A to 12D. The dimensional particulars of the antenna assembly employed in the measurement are as follows:

$$L = 5\lambda,\ t = 0.625\lambda,\quad = 2.2\lambda,\ \theta = 25^\circ$$
$$D = 0.78\lambda,\ d = 0.69\lambda$$

FIGS. 12A to 12D show the radiation patterns when d/D= 1, d/D=0.88, d/D=0.80 and d/D=0.66, respectively. As apparent from these figures, the side lobe levels are lowered as d/D becomes smaller. In contrast, the main lobe will be larger in width as d/D becomes smaller and the main lobe is diverged or branched, which is unsuitable as a radar antenna, when d/D is smaller than 0.80, for example, d/D is 0.66.

In view of these measurement results, the dimensional relationship between D and d is set as $0.8 \leqq d/D < 1$.

A second embodiment of the present invention will now be described referring to FIGS. 6 to 8.

Figure 6:
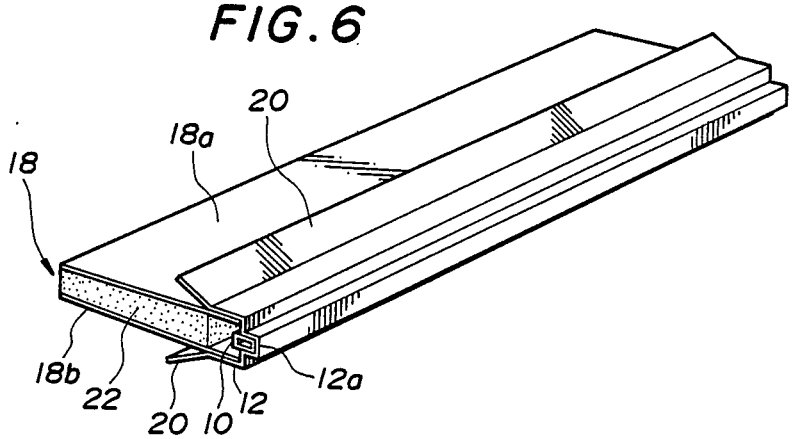
FIGS. 6 to 8 are perspective views of a second form of the slotted waveguide antenna assembly according to the present invention and modifications thereof.
Figure 7:
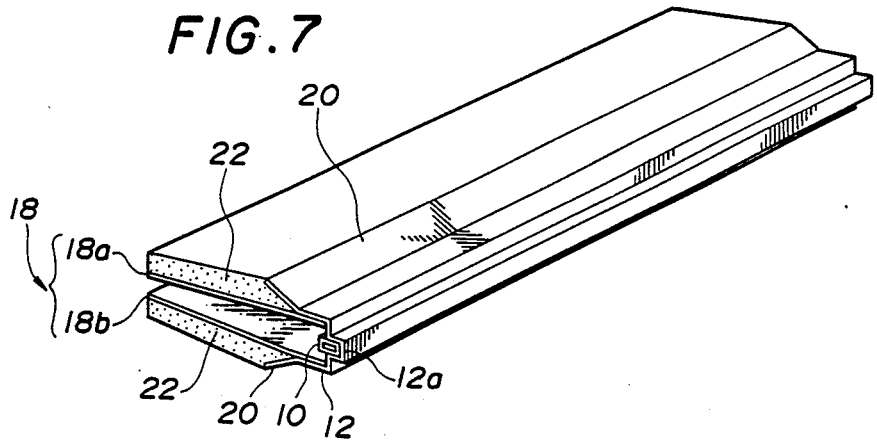
Figure 8:
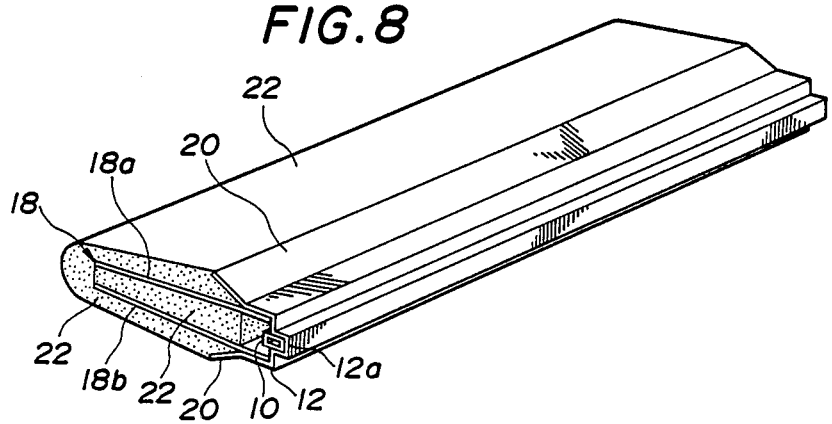

The second form of the slotted waveguide antenna assembly as illustrated in FIGS. 6 to 8 has all the characteristic features of the first embodiment as illustrated in FIGS. 1 and 2 wherein the slotted waveguide 10, the dielectric beam shaper 18 and the reflectors 20 are fixed and supported by the holder member 12, but the second form further comprises a dielectric plate supporting member (hereinafter referred to as "supporting member") 22 fitted to the dielectric plate members 18*a*, 18*b*.

The present invention is substantially identical with the first embodiment except for the supporting member 22 and therefore, only the difference is explained here.

The supporting member 22 is made of materials transparent to the working electromagnetic wave, i.e., dielectric materials having a specific inductive capacity of approximately 1. The supporting member 22 is fitted between and/or external to the dielectric plate members 18*a* and 18*b*.

FIGS. 6 to 8 illustrate the manners in which the supporting members 22 may be fitted to the dielectric plate members.

The antenna assembly of FIG. 6 has the supporting member 22 fitted between the dielectric plate members 18*a*, 18*b*. The antenna assembly of FIG. 7 has the supporting member 22 formed of two piece members fitted to the external surfaces of the dielectric plate members. The antenna assembly of FIG. 8 has the supporting members 22 fitted both between and external to the dielectric plate members.

The supporting member 22 is preferably made, for example, of expandable polystyrene. Although the materials of the supporting member 22 are not limited to foamed materials, the foamed materials are light in specific gravity and weight and do not substantially increase the weight of the antenna assembly when they are fitted to the antenna assembly. The foamed materials have other advantages in that the specific gravity and the extent of foaming may be selected to suitably set the specific inductive capacity. Thus, desired characteristics can be obtained.

The support member of foamed material is attached to the dielectric plate members, for example, in such a manner that a supporting member which is initially expanded in a mold so as to be formed in a desired shape, is inserted between the dielectric plate members 18*a*, 18*b* or fitted to the external surfaces of the respective dielectric plate members 18*a*, 18*b* and then bonded to the plate members by adhesives. Alternatively, by means of a suitable mold the dielectric plate members 18*a*, 18*b* are made to assume the desired nonparallel positions and the foamable material is expanded between the dielectric plate members 18*a*, 18*b* or between the external surfaces of the respective plate members and the mold.

Although the supporting member 22 may be filled to an extremity where it contacts the front face of the slotted waveguide 10, alternatively, there may be left a space in front of the waveguide 10. In the embodiments of FIGS. 6 and 8, the supporting member 22 is mounted leaving a space in front of the forward end of the slot waveguide 10 for allowing a grid for suppressing vertical polarization to be mounted in the space.

In these cases, it is preferred that the foamed materials have at the surfaces thereof dense and smooth skin layers for improving the strength of the surfaces.

In the embodiment of FIG. 8, the material of the supporting member 22 which is fitted between the dielectric plate members 18*a*, 18*b* may be the same as or different from the material of the supporting member 22 which is attached to the outside of the dielectric plate members.

In the arrangements as described above, when an electromagnetic wave is radiated from the slotted waveguide 10, the electromagnetic wave is incident upon the supporting member or members 22 in the embodiment as illustrated in FIG. 6 or FIG. 8. In the embodiment of FIG. 7, the electromagnetic wave is transmitted through the dielectric plate members 18*a*, 18*b* and then is incident upon the supporting member 22. In this connection, it is to be noted that since the relative dielectric constant of the supporting member 22 is approximately 1, it is substantially transparent to the electromagnetic wave and does not prevent propagation of the same. Therefore, the electromagnetic wave travelling through the supporting member 22 can be propagated substantially in the same manner as in the first embodiment of FIGS. 1 and 2 where no supporting member 22 is provided.

According to the second embodiment of FIGS. 6 to 8, the dielectric plate members cantilevered by the holder member are supported by the supporting member so that the nonparallel disposition of the dielectric plate members is maintained with high precision. In addition, the structural strength of the antenna assembly can be increased. Thus, undesired change in the distance between the dielectric plate members caused by wind or vibration or change in the angles of the dielectric plate members with reference to the horizontal plane can be prevented.

Figure 9:
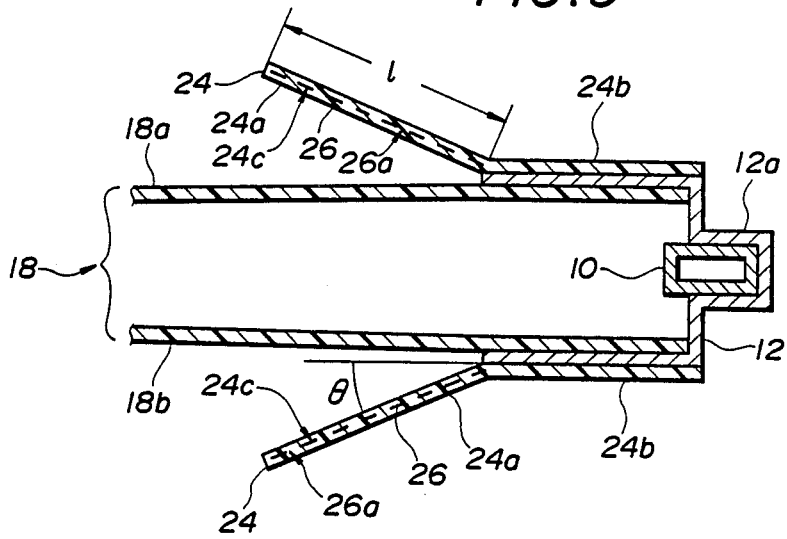
FIG. 9 is a fragmentary enlarged view of a third form of the slotted waveguide antenna assembly according to the present invention.

A third embodiment of the present invention will now be described while referring to FIGS. 9 to 10.

The third form of slotted waveguide antenna assembly according to the present invention comprises a slotted waveguide 10, a dielectric wave-guiding arrangement 18 and reflectors 24 which are fixed to and supported by a holder member 12.

The characteristic feature of the present embodiment is such that the reflectors 24 have reflecting layers of conductive materials provided within synthetic resin plates or on the surfaces thereof. Other structures than the reflectors 24 are substantially the same as those of the first embodiment.

The reflectors 24 are made of synthetic resin materials such as fiber reinforced plastics (FRP) which are formed from epoxy bonded glass fibers. Planar plates of the synthetic materials are bent at a predetermined angle so as to form the reflectors 24. This angle is same as that of the first embodiment as illustrated in FIG. 1 and it is 25°.

The base portion of each of the reflectors 24 is a mounting portion **24*b* for mounting the reflector 24 onto the holder member 12. The tip end portion of each of the reflectors 24 is a reflecting portion 24*a* for reflecting electromagnetic wave. The mounting portion 24*b* is fixed to the outside of the holder member 12 by adhesives and carries the reflecting portion 24*a*** at the tip end thereof.

At the reflecting portion **24*a*, a thin metal plate or sheet 26 is embedded at a position intermediate to the surfaces of the reflector 24 to form the reflecting layer 24*c*. The length 1 of the reflecting portion 24*a* is about twice the working wavelength of the reflector 20 in the first embodiment of FIG. 1. In the present embodiment, the length 1** is set to be 1.56 times the working wavelength.

Figure 10:
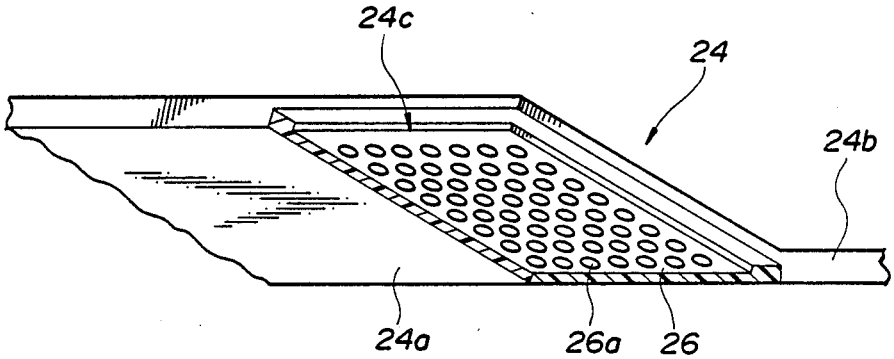
FIG. 10 is a partly cut-away perspective view of reflectors employable in the slotted waveguide antenna assembly of FIG. 9.

The metal plate or sheet 26 has a plurality of through-holes **26*a* as illustrated in FIG. 10. These through-holes 26*a* reduce the weight of the metal plate or sheet 26 and allow the synthetic resin to penetrate thereinto when the metal plate or sheet 26 is embedded, thereby to bond the synthetic resin layers on the opposite sides of the metal plate or sheet 26 therethrough. Thus, the reflecting portion 24*a* is reinforced by the metal plate or sheet 26**.

The size of each of the through-holes **26*a* is such that the maximum length thereof in the direction perpendicular to field vector of polarization of the working electromagnetic wave is half the wavelength of said electromagnetic wave or less so as not to transmit the electromagnetic wave to be reflected therethrough. In the present embodiment, the through-holes 26*a* are circular holes having a diameter of 3 mm for acquiring a sufficient reflection effect. However, the through-holes 26** are not limited to the circular holes and they may alternatively be square holes or slits.

In the arrangement as described above, when the electromagnetic wave radiated from the slotted waveguide 10 is transmitted through the dielectric plate members **18*a*, 18*b* and incident upon the reflectors 24, the wave is reflected by the reflecting layer 24*c* formed of the metal plate or sheet 26 so as to be propagated forwardly of the antenna assembly. At this time, the through-holes 26*a* formed on the metal plate or sheet 26** do not prevent the reflection of the electromagnetic wave because they are sufficiently small.

The above-mentioned arrangement has such an advantage that the total weight of the reflector 24 can be reduced because the substantial portion of the reflector 24 is formed of synthetic resin which is light in weight and the remaining portion is formed of very thin metal plate or sheet. This advantageously enables the thickness of the holder member 12 supporting the reflector 12 to be reduced. Thus, the entire antenna assembly can be lighter in weight.

As a result, the rotational load from rotating the antenna assembly by a rotation drive system is reduced and the rotation drive system can be made smaller. Furthermore, when the antenna assembly is used for marine radars or the like, the weight on a foremast on which the antenna assembly is mounted can be reduced, and thus the possibility of capsizing in rough seas can be minimized.

Although the reflectors 24 are separately formed from the holder member 12 in the present embodiment, they may be formed integrally with each other.

The structure of the reflector is not limited to that as employed in the present embodiment, and it may be any one of the structures as will be described later in connection with further embodiments of the present invention.

Although the reflecting layer **24*c* is formed of a metal plate or sheet having a plurality of through-holes in the present embodiment, it may be embodied in other forms. For example, metal net may be used instead of the metal plate or sheet in such a way that it is embedded in synthetic resin material. Alternatively, the reflector may have, at a surface thereof, a conductive layer which functions as a reflecting layer 24*c*. The reflector may alternatively include a conductive cloth containing metallic fibers which is embedded within a synthetic resin material. The reflecting layer 24*c*** is not always needed to be perforated or have a net-like structure, but it may be continuous.

When it is required to further reinforce the reflector, a rib or ribs may be formed so as to extend along the length of the reflector from the mounting portion to the reflecting portion or an overlay may be provided.

A fourth embodiment of the present invention will now be described, referring to FIGS. 11 and 12.

Figure 11:
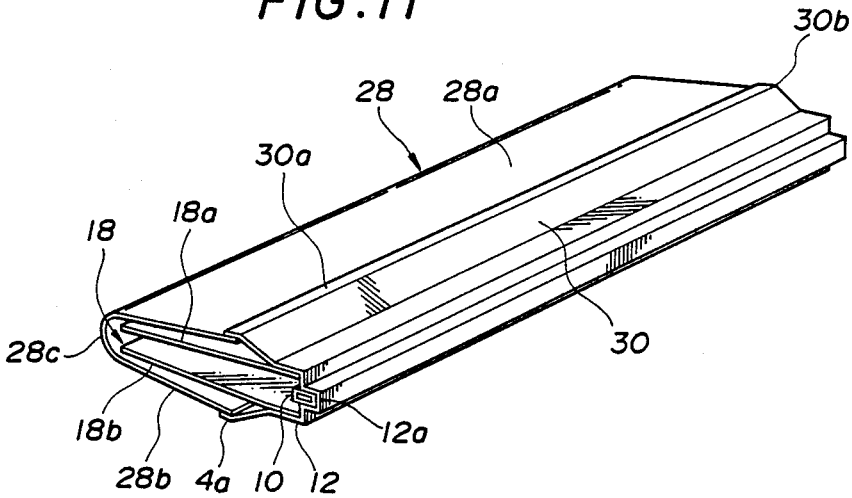
FIG. 11 is a perspective view of a fourth form of the slotted waveguide antenna assembly according to the present invention.
Figure 12A:
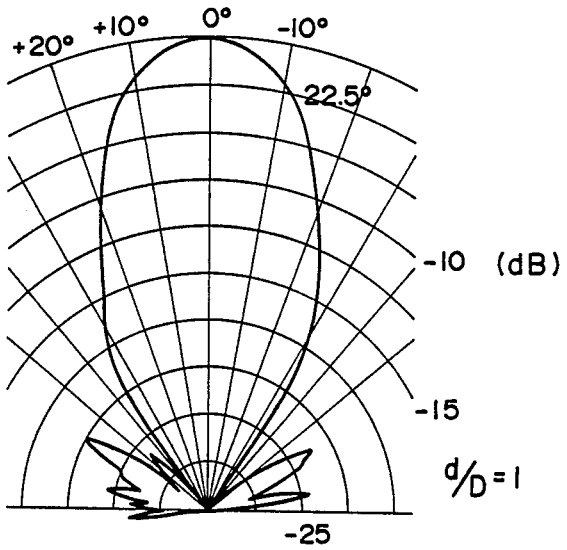
FIGS. 12A to 12D are characteristic diagrams of actually measured radiation patterns of a slotted waveguide antenna assembly similar to the first embodiment, with the angles of the dielectric plate members varied.
Figure 12B:
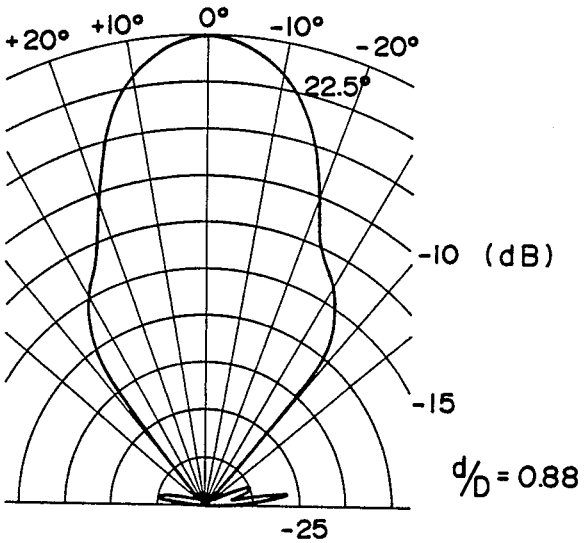
Figure 12C:
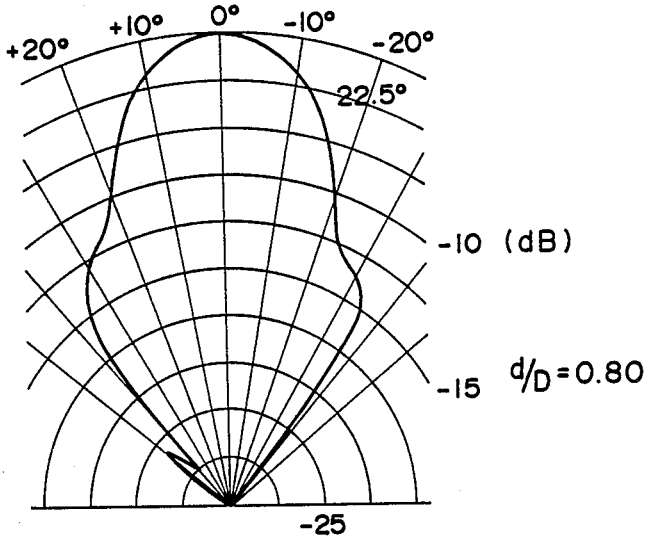
Figure 12D:
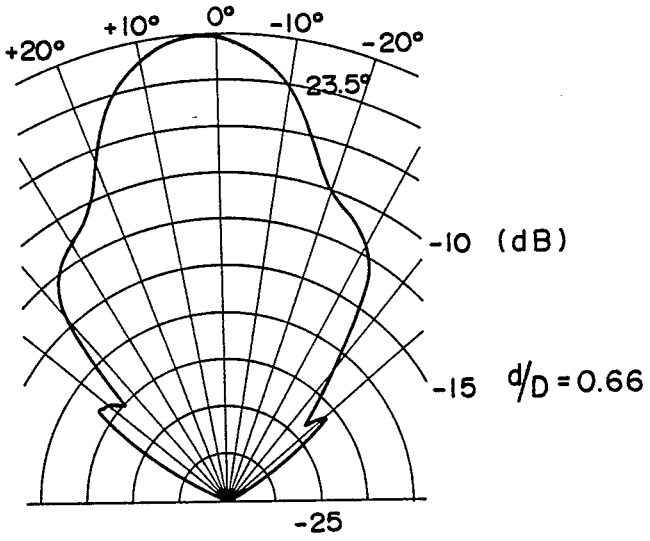

The fourth form of the slotted waveguide antenna assembly embodying the present invention is illustrated in FIG. 11 and has the basic structure of the first embodiment in the slotted waveguide 10, a dielectric beam shaper 18 and reflectors 30 which are fixed and supported by a holder member 12 are provided. This embodiment further comprises a radome 28. The radome 28 is formed of a dielectric plate having a thickness sufficiently thin as compared with the working wavelength and disposed at the outside of dielectric plate members 18*a*, 18*b* of the first dielectric beam shaper to enclose them.

The present invention is substantially the same as the first embodiment except for the dielectric radome 28 and the reflectors 30.

The radome 28 is formed of dielectric plate members 28*a*, 28*b* made of fiber reinforced plastics (FRP) and shaped in a U-form in section. The base portions of the dielectric plate members 28*a*, 28*b* are fixed to horizontal projections 30*a* provided at aperture portions 30*b*, defined by the reflectors 30 in such a manner that the dielectric plate members 28*a*, 28*b* may cover the external surfaces of the respective dielectric plate members 18*a*, 18*b*. The beam shaper 28 is so disposed as to sandwich the first dielectric beam shaper 18, keeping a given space therefrom. The second dielectric beam shaper 28 may be made of materials the same or different as the materials of the first dielectric plate members 18*a*, 18*b*.

The thickness of each of the dielectric plate members 28*a*, 28*b* is sufficiently thin as compared with the working wavelength of the dielectric plate members 18*a*, 18*b*, and, for example, is one tenth of the working wavelength. In the present embodiment, the thickness t is 0.05 wavelength. Although the thickness t is not limited to this value, it is preferably thinner as the dielectric constant becomes larger, for the same reason as described referring to the dielectric plate members 18*a*, 18*b*. The radome 28 may preferably be configured to be smaller or tapered, in section, at its forward end portion. In this case, air resistance can be reduced.

In the present embodiment, if the opposite ends of the antenna assembly are covered by some suitable end plate members (not shown), the dielectric beam shaper 18 and the slotted waveguide 10 is sealed therein. Therefore, wind pressure can be reduced and penetration of water or dust can be prevented.

The reflectors 30 are made of metal plates or plates having metallized walls similarly to the holder member 12. The reflectors 30 of the present embodiment are substantially the same as those of FIG. 1 except that they have horizontal projections 30*a* at the aperture portion 30*b*.

Each of the horizontal projections 30*a* is formed by bending each of the tip ends of the respective reflectors 30 at the aperture portion 30*b* in a direction substantially parallel to the propagation direction of the main lobe of the radiated electromagnetic wave. This horizontal projection 30*a* will be described in more detail later in connection with a further embodiment of the present invention.

The characteristic operation of the present embodiment will now be described.

In the fourth embodiment, the operation is identical with those of the other embodiments except for the operation of the radome 28. Therefore, only the operation of the radome is explained here.

The radome 28 covers the dielectric beam shaper 18 and protects the beam shaper 18 and the slotted waveguide 10 from the environment such as rain, wind, etc. Especially, water, e.g. rain, is effectively prevented from entering the slotted waveguide 10.

The provision of the radome 28 which covers the aperture of the reflectors 24 can reduce the influence of wind pressure against the reflectors 24.

If the radome 28 is so formed that its portions 28*a*, 28*b* extending along the dielectric plate members 18*a*, 18*b* are made similar, in material and thickness, to those of the dielectric plate members 18*a*, 18*b*, it also functions as a beam shaper. More particularly, the radome 28 is made of a dielectric material similar to that of the dielectric plate members 18*a*, 18*b* and the thickness of the material is so selected that the electromagnetic waves reflected by the inner surfaces of the dielectric plate members 18*a*, 18*b* towards the inner space of the radome 28 may have such a phase difference from the electromagnetic waves propagated therethrough and reflected at the interface of the opposite face towards the inner space of the radome 28 that the waves are substantially cancelled by each other. The portions 28*a*, 28*b* of the radome extending along the dielectric plate members 18*a*, 18*b* are disposed in parallel or to be closer at the forward, tip end portions.

With the radome arranged as described above, the beam shaping effect contributes to sharpening of the main lobe more than lowering of the side lobe level. This effect has not been analyzed theoretically but confirmed experimentally by the inventors.

Figure 13:
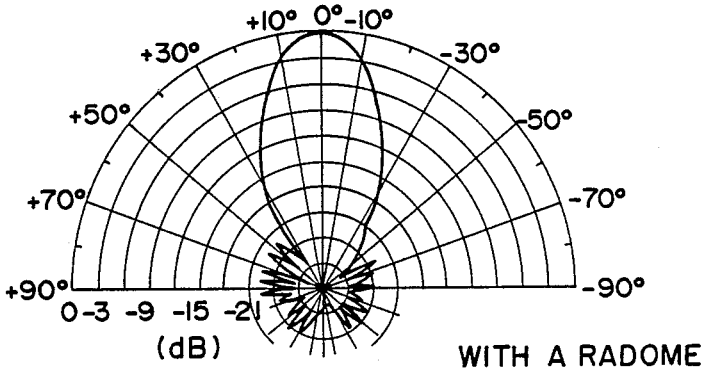
FIG. 13 is a characteristic diagram of an actually measured radiation pattern of the slotted waveguide antenna assembly of FIG. 11.
Figure 14:
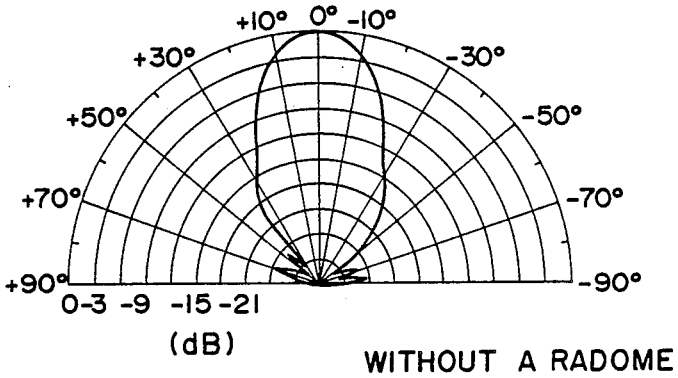
FIG. 14 is a characteristic diagram of an actually measured radiation pattern of the slotted waveguide antenna assembly of FIG. 11 with a second dielectric beam shaper removed.

FIGS. 13 and 14 are actually measured radiation patterns which show the beam shaping effects by the radome 28. FIG. 13 is an actually measured radiation pattern of the present embodiment and FIG. 14 is an actually measured radiation pattern of the antenna assembly similar to that of the present embodiment with the radome removed. The dimensional particulars for the measurement are similar to those of the first embodiments.

In comparison, the antenna assembly of the fourth embodiment has a higher side lobe than the antenna assembly without the second dielectric beam shaper. However, the level of the side lobe of the former antenna assembly still remains within a sufficiently low level range and is negligible in practical use. On the other hand, the beam half-width, i.e., −3 dB beam width is as sharp as 22° in the former antenna assembly while it is 24° in the latter antenna assembly. Thus, an antenna gain is increased in the former case.

As can be understood from the foregoing, the present embodiment enables the main lobe to be sharpened, while keeping the increase in the side lobe at a low level, owing to the radome 28.

The tip portions of the radome 28 are not limited to curved ones but may be planar.

The radome 28 may have a spacer or spacers for keeping its forward, tip end portions from coming into contact with the corresponding dielectric plate members 18*a*, 18*b*. The spacer or spacers are preferably made of materials causing little reflection with respect to the working electromagnetic wave, i.e., materials having a relative dielectric constant of substantially 1 so as not to scatter the electromagnetic wave.

The antenna assembly of this embodiment may further comprise supporting members as used in the second embodiment inside of the radome 28. The attachment of these supporting members may be carried out in a similar manner to the case of the second embodiment. The supporting members can assure precise distancing of dielectric members 28*a*, 28*b* from dielectric plate members 18*a*,18*b*, respectively and can suppress the vibration of the dielectric plate members 18*a*, 18*b*.

The reflectors of the present embodiment may alternatively be made of synthetic resins as in the third embodiment.

FIGS. 15 to 18 illustrate a fifth embodiment of the present invention.

The fifth form of the slotted waveguide antenna assembly according to the present invention, comprises a slotted waveguide 10, a dielectric beam shaper 18, reflectors 32 and grid member 38 supported and fixed by a holder member 14. In this embodiment, a radome 44 is fitted to an aperture portion defined by the reflectors.

In the present embodiment, the slotted waveguide 10 and the dielectric beam shaper 18 are identical with those as used in the foregoing embodiments, but the holder member 14, the reflectors 32, the radome 44 and the grid member 38 are different from those of the foregoing embodiments or have no corresponding element.

Figure 16:
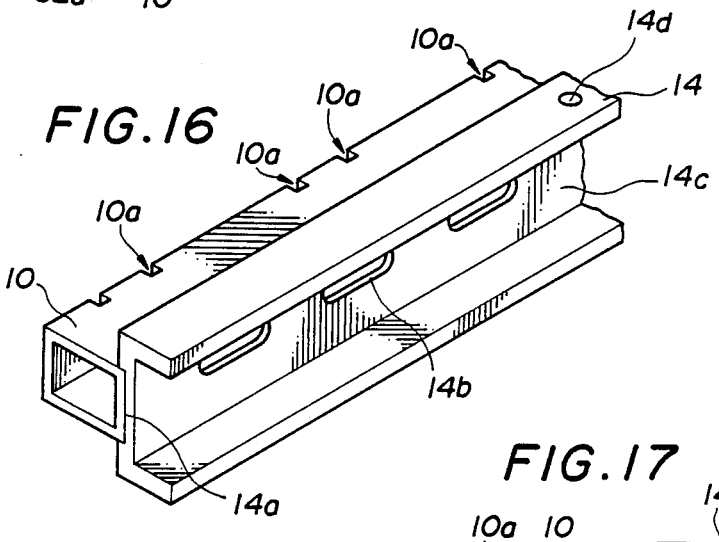
FIG. 16 is a fragmentary perspective view of a holder employable in the slotted waveguide antenna assembly of FIG. 15.
Figure 17:
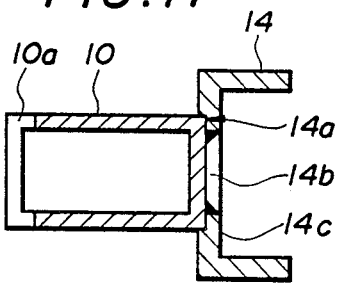
FIG. 17 is a sectional view of the holder of FIG. 16.

The holder member 14 is made of a channel-shaped metal material and has a groove 14*a* extending centrally along the length of a web 14*c* as illustrated in FIGS. 16 and 17. The groove 14*a* has through-holes 14*b*.

The through-holes 14*b* are disposed at the groove 14*a* along the length thereof. Although the through-holes 14*b* are elongated slots in the embodiment as illustrated, they may alternatively be circular holes or slits. As the case may be, one through-hole will suffice. The through-holes are provided at a position where the slotted waveguide 10 is to be placed so that the magnetic wave will not be leaked therefrom.

Since slots are formed at the front face of the slotted waveguide 10, the slotted waveguide 10 is fixed to the holding member 14 in such a manner that the rear side thereof is fitted in the groove 14*a* and welded to the inner walls of the through-holes 14*b*. Alternatively, the fixing of the waveguide 10 to the holder member 14 may be attained by any suitable means such as bonding by adhesives or securing by screws.

Figure 15:
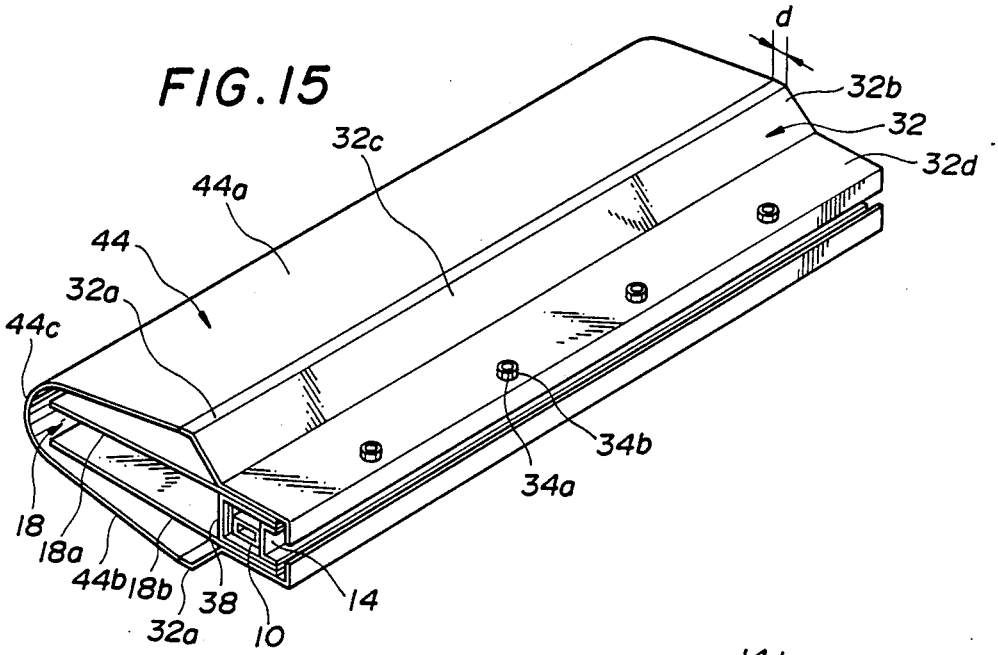
FIG. 15 is a perspective view of a fifth form of the slotted waveguide antenna assembly according to the present invention.

The holder member 14 has parallel portions, and holes are formed on the parallel portions as designated by 14*d* in FIGS. 15 and 16. The dielectric plate members 18*a*, 18*b*, reflectors 32 and grid members 38 are fixed to the holder member 14 by bolts and nuts 34*a*, 34*b* fitted in the holes 14*d*. The spacing between the parallel portions is selected to be smaller than the working wavelength and larger than half of the wavelength.

The reflectors 32 are made of synthetic resinous materials such as fiber reinforced plastics (FRP) and are formed from planar plates which are bent at a predetermined angle. The base portion of each of the reflectors 32 is a mounting portion for the holder member 14 and the tip end portion thereof is a reflecting portion 32*c* for the electromagnetic wave. The mounting portion 32*d* is fixed to the outside of the holder 14 and supports the reflecting portion 32*c*.

The internal structure of each of the reflectors 32 is identical with that of the reflector 24 as illustrated in FIG. 10. More particularly, a thin metal plate or sheet with a number of holes is embedded at an intermediate level to form a reflecting layer. This reflecting layer may of course be made of metal net or the like as described in connection with the third embodiment.

The front ends of an aperture 32*b* of the reflectors 32 have horizontal projections 32*a* extending substantially in parallel with the radiation direction of the main lobe. The projection, however, may be nonparallel with the radiation direction of the main lobe so long as impedance matching is acquired and the planar portion of equiphase plane is increased. The projection 32*a* has a length d in the direction of the radiation of the main lobe which is set to be about one fourth of the wavelength of the working electromagnetic wave.

Although the reflectors may be made of metal, they can advantageously be made of synthetic resins which are light in weight and can reduce the load on the rotationary drive system.

The radome 44 is made of dielectric sheet materials and is generally formed in a U-shape. The aperture portion of the radome is connected and fixed to the horizontal projections 32*a* of the reflectors 32. In the present embodiment, the tip end 44*c* of the radome is curved, but it may be planar. The radome may be formed not only to function as a cover for the dielectric beam shaper 18 and the slotted waveguide 10, but to function to sharpen the main lobe as the dielectric as described in the fourth embodiment. In this case, the thickness of the sheet material should be sufficiently thin as compared with the wave-length of the working electromagnetic wave, and portions 44*a*, 44*b*, which extend along the dielectric plate members 18*a*, 18*b*, could be kept at given spaces therefrom. In brief, these conditions are substantially the same as those of the dielectric beam shaper 28 in the fourth embodiment.

This radome 44 has the function of sharpening the beam of the radiated electromagnetic wave as well as functioning as a cover as mentioned above. It is preferred that the radome be installed, but it may be omitted if desired.

A supporting member of foamed material as shown in the second embodiment may be provided in a space defined by the radome 44. The supporting member enhances operation of the antenna assembly of this embodiment.

The grid member 38 is made of a metal plate bent into a channel shape. As illustrated in FIG. 18, a number of slits 38*a* extending in the vertical direction are provided at intervals in the longitudinal direction of a web 38*b* of the grid member 38. This grid member 38 is so mounted onto the holder member 14 that the parallel portions of the holder member 14 are fitted in the opening of the channel and they are fixed by the bolts 34*a* and nuts 34*b* inserted in the holes 38*c*.

The slit 38*a* extends through the height of the web 38*b* and the height h is set to be half the working wavelength so as not to suppress horizontal polarization components to be radiated. The width s of the slit 38*a* is set to be smaller than half the wavelength so as to suppress vertical polarization components. The interval k between the slits 38*a* is also set to be small to prevent reflection at this portion. In the embodiment as illustrated, the height h is 25 mm, the width s is 2 mm and the interval k is 2 mm.

The grid member 38 is held between the base portions of the respective dielectric plate members 18*a*, 18*b* and fitted so as to cover the front face of the slotted waveguide 10.

The operation of the present embodiment will now be described. However, the operation of the dielectric beam shaper 18, the operation of the radome 44 functioning as a second dielectric beam shaper and other operations (except for the horizontal projections 32*a* of the reflectors 32) are similar to those as described before in connection with other embodiments and they are not explained here.

The horizontal projection 32*a* of the reflector 32 allows the equiphase plane of the radiated electromagnetic wave to be planar and allows the impedances of the inside of the reflector 32 and the outside free space to be matched. This enables focussing of the main lobe, suppression of the side lobe and prevention of an undesired reflected wave at the aperture end of the reflector.

With the projection 32*a*, the side lobe level which is about −20 dB when no projection is provided can be reduced to −22 dB or less.

The horizontal projections have a further advantage of making connection with the radome 44 easier.

In the present embodiment, the slotted waveguide 10 is fixed to the holder member 14 by welding etc. through the holes 14*d* formed along the length of the holder member 14. Therefore, the rear face of the slotted waveguide 10 is firmly attached to the holder member 14 through the length thereof. For this reason, the holder member 14 acts as a reinforcing rib so as to prevent undesired bending of the slotted waveguide 10 during and after its mounting.

Since the slotted waveguide 10 is fixed only at its ends in the foregoing embodiments, the weight loaded on the fixed portion is somewhat heavy and the rotational moment is also somewhat large. According to the present embodiment, the slotted waveguide 10 has a plurality of its portions welded to holder member 14 so as to be supported at a plurality of locations, the weight loaded can be reduced as a whole and the rotational moment can also be reduced.

Further according to the present embodiment, the grid member 38, dielectric wave-guiding arrangement 18 and the reflectors 32 can be fabricated at a time after the slotted waveguide 10 has been fixed to the holder member 14, so that the fabrication process can be simplified.

The grid member 38 of the present embodiment can suppress the vertical polarization of the electromagnetic wave radiated from the slotted waveguide 10, while allowing the horizontal polarization component to be radiated outwardly by the operation of the slits 38*a*.

The grid members 38 may also be employed in the antenna assemblies of other embodiments.

Modifications of the foregoing embodiments will now be described.

Although symmetry of the arrangement of the dielectric plate members are not referred to in the foregoing embodiments, it should be considered to obtain the desired beam pattern according to its uses. For example, when a strictly symmetric pattern is required, the dielectric plate members are preferably disposed symmetrically with reference to a horizontal plane containing the axis of the slotted waveguide. On the other hand, a when an assymetric pattern is required dielectric plate members of different lengths may be employed, or the dielectric plate members may be disposed at different angles. Alternatively, the angles of the reflectors may be different.

The holding mechanism of the fifth embodiment may be applied to the first to fourth embodiments for holding the slotted waveguide 10. In this case, holes are formed in the groove 12*a* of the holder 12 for fixing the slotted waveguide 10 through the holes.

FIGS. 19A to 19E show a variety of modifications of the dielectric plate member employable in each of the foregoing embodiments. In these modifications the tip ends 42*a*–42of the dielectric plate members 40*a*–40*e* are processed into tapered forms or rounded forms. These shapes are preferable for radiating the electromagnetic wave trapped within the dielectric plate member so as to prevent formation of back lobe due to reflection at the tip end of the dielectric plate member.

Each of the dielectric plate members 40*a* to 40*e* has slanting faces 42*a* to 42*d* or a rounded face 42*e* to form the tip end portion thereof narrower. The length through which the slanting faces are formed is preferably long to reduce the inclination of the slanting faces. It is theoretically presumed that when the inclination angle of the slanting faces is reduced, the radiation effect of the electromagnetic wave is enhanced. However, according to the experiments conducted by the inventors of the present invention, there is no need to prolong the length to over twice the wavelength. If it is necessary to suppress the back lobe sufficiently, however, the length should be at least one fourth of the wavelength.

Figure 20:
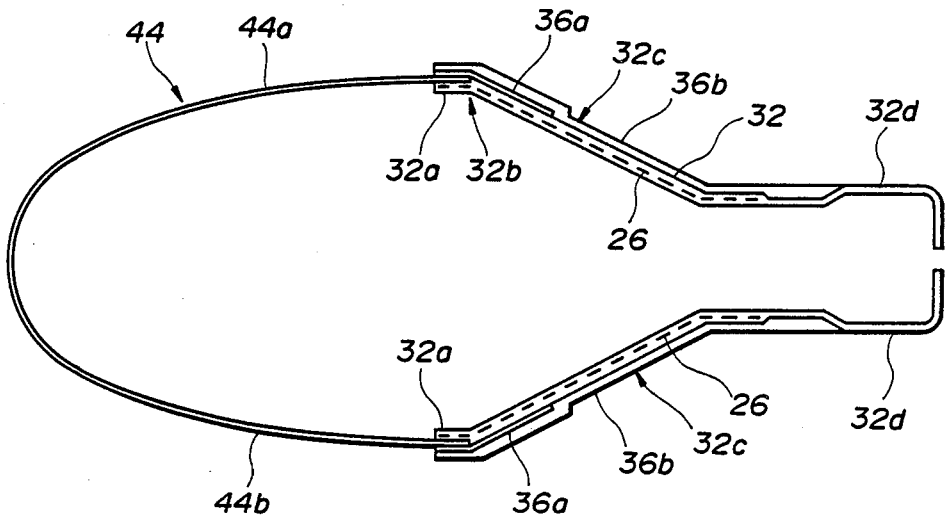
FIG. 20 is a side elevational view of a structure in which reflectors and a radome are formed integrally with each other and which is employable for reflectors made of synthetic resins.

FIG. 20 illustrates a modification in which reflectors of synthetic resinous materials and a radome are integrally formed with each other.

In the modification as illustrated, reflectors 32 having a reflecting layer formed of metal plate or sheet 26 embedded in the resinous materials and a radome 44 formed of dielectric sheet bent generally in U-shape are connected to each other at the respective aperture portions. This structure may be applied to the embodiments using reflectors made of synthetic resinous materials.

Overlays 36*a* are provided at opening portions 32*b* of the respective reflectors 32 where the radome 44 is connected to the reflectors 32 in such a manner that they cover the edge portions of the radome along the length thereof. Other overlays 36*b* are also provided on the respective reflectors 32 so as to extend from horizontal projections 32*a* to mounting portions 32*d* of the respective reflectors 32. The latter overlays 36*b* are for reinforcement of the reflectors 32, and they are made of FRP plates, metal plates, etc. and disposed at suitable intervals in the longitudinal direction of the reflectors 32.

In this structure, the reflectors 32 and the radome 44 are assembled to form an integral cover member. Therefore, complete sealing of the antenna assembly from water etc. can be attained. In addition, the fabrication can be made easily.

When the radome 44 is sufficiently thin as compared with the working wavelength of the electromagnetic wave and it has portions 44*a*, 44*b* which extend along the dielectric plate members of the dielectric waveguide arrangement, respectively, keeping given spaces therefrom, it also functions as a second dielectric beam shaper. In this case, it functions to sharpen the main lobe.

Although the reflectors are formed of planar plates in the foregoing embodiments, they may be formed of curved plates having parabolic faces.

Although for the purpose of explaining the invention particular embodiments and modifications thereof have been shown and described, other modifications within the spirit and scope of this invention will occur to persons skilled in the art.

We claim:

1. A slotted waveguide antenna assembly including a slotted waveguide which is fixed and held, at its back side, by a holder member, which assembly comprises:

a dielectric beam shaper formed of a pair of dielectric plate members, said dielectric plate members having base portions which are supported by said holder member and having forward end portions which extend to project forwardly of said slotted waveguide to define a space therebetween; and a pair of reflectors provided at the base portions of the respective dielectric plate members and supported by said holder member for reflecting electromagnetic waves radiated through the base portions of the respective dielectric plate members;

said dielectric plate members having a thickness which produces a phase difference, between electromagnetic waves reflected by inner surfaces of the respective dielectric plate members and directed to the space between the dielectric plate members and electromagnetic waves reflected by interfaces at external surfaces of the respective dielectric plate members and directed to the space between the dielectric plate members, the phase difference causing the reflected electromagnetic waves directed to the space between the dielectric plate members to substantially cancel each other;

said pair of dielectric plate members being disposed apart a distance D at the base portions thereof, which differs from a distance d between the dielectric plate members at the forward portions thereof, such that the ratio d/D is given by the following relation $0.8 \leqq d/D < 1$.

2. A slotted waveguide antenna assembly as claimed in claim 1, which further comprises a supporting member or plate members and/or on the external surfaces of the respective dielectric plate members, said supporting member or members being made of a foam material substantially transparent to working electromagnetic waves.

3. A slotted waveguide antenna assembly as claimed in claim 1, wherein said distance D is selected to be shorter than a wavelength of working electromagnetic waves.

4. A slotted wavelength antenna assembly as claimed in claim 1, which further comprises a radome made of a dielectric material which covers said pair of dielectric plate members.

5. A slotted wavelength antenna assembly as claimed in claim 4, wherein said radome is made of a dielectric plate having a thickness which produces such a phase difference, between electromagnetic waves reflected by an inner surface of said dielectric plate towards ann interior space of said radome and electromagnetic waves reflected by an interface at an external surface of the dielectric plate towards said interior space, that the reflected electromagnetic waves reflected towards the interior space substantially cancel each other.

6. A slotted wavelength antenna assembly as claimed in claim 4, which further comprises a supporting member made of a foam material substantially transparent to a working electromagnetic wave and provided between said dielectric plate members and on the external surfaces of the respective dielectric plate members; and a radome provided outside of said supporting member.

7. A slotted waveguide antenna assembly as claimed in claim 6, wherein said radome is made of a dielectric plate having a thickness which produces such a phase difference, between electromagnetic waves reflected by an inner surface of said dielectric plate towards an interior space of said radome and electromagnetic waves reflected by an interface at an external surface of the dielectric plate towards said interior space, that the reflected electromagnetic waves reflected towards the interior space substantially cancel each other.

8. A slotted waveguide antenna assembly as claimed in claim 1, wherein each of said reflectors has a reflecting layer made of a conducting material provided in or on a synthetic resin plate.

9. A slotted waveguide antenna assembly as claimed in claim 1, wherein said reflectors are each made of cloth containing metallic fibers, which is embedded in a synthetic resin plate.

10. A slotted waveguide antenna assembly as claimed in claim 4, wherein each of said reflectors has a reflecting layer made of a conducting material provided in or on a synthetic resin plate and said reflectors and said radome are formed integrally as a cover.

11. A slotted waveguide antenna assembly as claimed in claim 1, wherein said holder member is a channel member having a pair of parallel sides and said pair of dielectric plate members are disposed along external surfaces of said parallel sides of the holder member, respectively.

12. A slotted waveguide antenna assembly as claimed in claim 11, wherein a distance between said parallel sides of said channel member is selected to be shorter than a wavelength of working electromagnetic waves to allow the distance D between the dielectric plate members at their base portions to be shorter than the wavelength of the working electromagnetic waves.

13. A slotted waveguide antenna assembly as claimed in claim 11, wherein each of said reflectors has a reflecting layer made of a conducting material provided in or on a synthetic resin plate, said reflectors and said radome being combined integrally to form a cover, said cover enclosing said pair of dielectric plate members and said cover being fixed, at its base portions, to said holder member.

14. A slotted waveguide antenna assembly as claimed in claim 13, which further comprises a supporting member made of a foam material substantially transparent to a working electromagnetic wave and provided between said dielectric plate members and on the external surfaces of the respective dielectric plate members, and in which said radome is disposed outside of said supporting member.

15. A slotted waveguide antenna assembly as claimed in claim 14, wherein said radome is made of a dielectric plate having a thickness which produces such a phase difference, between electromagnetic waves reflected by an inner surface of said dielectric plate towards an interior space of said radome and electromagnetic waves reflected by an interface at an external surface of the dielectric plate towards said interior space, that the reflected electromagnetic waves reflected towards the interior space substantially cancel each other.

* * * * *